US010022639B2

(12) United States Patent
Sato

(10) Patent No.: US 10,022,639 B2
(45) Date of Patent: Jul. 17, 2018

(54) MODEL VEHICLE CONTROL DEVICE AND COMPUTER PROGRAM FOR MODEL VEHICLE CONTROL

(71) Applicant: TOMY TEC CO., LTD., Tochigi (JP)

(72) Inventor: Morio Sato, Machida (JP)

(73) Assignee: TOMY TEC CO., LTD., Tochigi (JP)

( * ) Notice: Subject to any disclaimer, the term of this patent is extended or adjusted under 35 U.S.C. 154(b) by 175 days.

(21) Appl. No.: 15/153,852

(22) Filed: May 13, 2016

(65) Prior Publication Data

US 2016/0332087 A1 Nov. 17, 2016

(30) Foreign Application Priority Data

May 14, 2015 (JP) ..... 2015-099447

(51) Int. Cl.

| | |
|---|---|
| ***A63H 19/24*** | (2006.01) |
| ***A63H 18/12*** | (2006.01) |
| ***A63H 18/16*** | (2006.01) |
| ***A63H 19/32*** | (2006.01) |
| ***B61L 27/04*** | (2006.01) |

(52) U.S. Cl.

CPC ..... *A63H 19/24* (2013.01); *A63H 18/12* (2013.01); *A63H 18/16* (2013.01); *A63H 19/32* (2013.01); *B61L 27/04* (2013.01); *A63H 2019/243* (2013.01); *A63H 2019/246* (2013.01)

(58) Field of Classification Search

CPC ..... A63H 18/16; A63H 19/24; B61L 27/04

See application file for complete search history.

(56) References Cited

U.S. PATENT DOCUMENTS 6,237,500 B1 * 5/2001 Lund ..... B61B 13/00 104/130.01
6,539,292 B1 * 3/2003 Ames, Jr. ..... A63H 19/10 105/1.4
2016/0347204 A1 * 12/2016 Takigawa ..... B61L 3/006

FOREIGN PATENT DOCUMENTS

JP 2003-225472 8/2003

OTHER PUBLICATIONS

Espacenet Abstract of JP 2003-225472, published Aug. 12, 2003.

* cited by examiner

*Primary Examiner* — Yonel Beaulieu
*Assistant Examiner* — Martin A Weeks
(74) *Attorney, Agent, or Firm* — Staas & Halsey LLP

(57) ABSTRACT

A model vehicle control device and method to realize section block control with high extensibility, which can flexibly support various layouts. A section determination unit determines whether a preceding vehicle exists in a section that a vehicle is about to enter. An entry condition determination unit determines, when the vehicle is about to enter a section with constraint, whether a current state in the section satisfies an entry condition. When the current state of the section with constraint does not satisfy the entry condition, a section control unit does not allow entry of a target vehicle to the section, regardless of a determination result of the section determination unit, until the section becomes a state that satisfies the entry condition.

4 Claims, 10 Drawing Sheets

VEHICLE POSITION TABLE

| SECTION | VEHICLE |
|---|---|
| 1a | A |
| 1b | 0 |
| 1c | 0 |
| 1d | 0 |
| 1e | 0 |
| 1f | 0 |
| 1g | 0 |
| 1h | B |
| 1i | 0 |

FIG. 4

SECTION TABLE

| SECTION | RIGHT OF POSESSION |
|---|---|
| 1a | A |
| 1b | 0 |
| 1c | 0 |
| 1d | 0 |
| 1e | 0 |
| 1f | 0 |
| 1g | 0 |
| 1h | B |
| 1i | 0 |

FIG. 5

TRAVELING PATHS

| | |
|---|---|
| VEHICLE A | 1a→ 1b→ 1c→ 1d→ 1e→ 1f→ 1g→ 1a |
| VEHICLE B | 1h→ 1b→ 1c→ 1d→ 1e→ 1i |

| SECTION | Initial State | t 0 | t 1 | t 2 | t 3 | t 4 | t 5 | | | | | |
|---|---|---|---|---|---|---|---|---|---|---|---|---|
| 1 a | **A** | **A** | | | | A | A | A | **A** | **A** | **A** | **A** |
| 1 b | | A | **A** | | | | B | **B** | | | | |
| 1 c | | A | A | **A** | | | B | B | **B** | | | |
| 1 d | | A | A | A | **A** | | B | B | B | **B** | | |
| 1 e | | | A | A | A | **A** | | B | B | B | **B** | |
| 1 f | | | | A | A | A | **A** | | | | | |
| 1 g | | | | | A | A | A | **A** | | | | |
| 1 h | **B** | **B** | **B** | **B** | **B** | **B** | **B** | | | | | |
| 1 i | | | | | | | | | B | B | B | **B** |

MODEL VEHICLE CONTROL DEVICE AND COMPUTER PROGRAM FOR MODEL VEHICLE CONTROL

CROSS-REFERENCE TO RELATED APPLICATIONS

This application is based upon and claims the benefit of priority of the prior Japanese Patent Application No. 2015-099447, filed May 14, 2015 the entire contents of which are incorporated herein by reference.

BACKGROUND OF THE INVENTION

Field of the Invention

The present invention relates to a model vehicle control device and a computer program for model vehicle control, and especially relates to exclusive control of a vehicle that enters a section set in a layout.

Description of the Related Art

JP 2003-225472 A discloses a vehicle driving device that performs individual control of a plurality of vehicles by causing a current to flow only in a necessary section in a layout that is made of a plurality of electrically separated sections. This vehicle driving device avoids collision of the vehicles traveling on the layout by performing exclusive control of not allowing the plurality of vehicles to enter a section that is to become an entry destination, that is, section block control.

However, JP 2003-225472 A described above discloses a basic concept of the section block control, exemplarily using a simple layout that is a combination of regular points with an endless, and extensibility to flexibly support various configurations of layouts is not taken into account. Configurations of actual layouts vary, and there may be a configuration that cannot prevent the collision of the vehicles only by the simple section block control. Further, JP 2003-225472 A exclusively focuses on the layout of the same type of model vehicles (railway models). However, in a complex layout where different types of separately controlled model vehicles such as a tram and a bus travel, integrated control to prevent collision of the different types of vehicles at a crossing or the like is desired.

SUMMARY OF THE INVENTION

The present invention has been made in view of the foregoing, and an objective is to realize section block control with high extensibility, which can flexibly support various layouts.

A first invention provides a model vehicle control device that controls entry of a first model vehicle to a section set to a first layout based on information from a position sensor that detects a position of the first model vehicle traveling on the first layout, where the first layout on which the first model vehicle travels and a second layout on which a second model vehicle of a different type from the first model vehicle travels are integrated, the control device. This model vehicle control device has a first section table, a section determination unit, and a section control unit. The first section table is configured to manage, for each section on the first layout, existence or non-existence of right of possession that is right for the first model vehicle to exclusively use a section. The section determination unit is configured to determine, by reference to the first section table, whether the right of possession is set to a second section that a target vehicle is about to enter, next to a first section, the target vehicle being the first model vehicle that is to become an object to be controlled and existing in the first section. The entry condition determination unit is configured to determine whether the right of possession is set to a third section set to the second layout on which the second model vehicle travels, by reference to a second section table that manages, for each section on the second layout, existence or non-existence of the right of possession that is right for the second model vehicle to exclusively use a section, when the second section is a section with constraint set in advance as a section crossing with the third section. The section control unit is configured to perform exclusive control of not allowing a predetermined number or more of the first model vehicles to enter the second section, based on a determination result of the section determination unit, and not to allow entry of the target vehicle to the second section, regardless of the determination result of the section determination unit, until the right of possession of the third section is released, when the second section is the section with constraint, and the right of possession is set to the third section.

In the first invention, the first model vehicle may be a railway model vehicle that travels on a rail by power feed from an outside, and the second model vehicle may be a model vehicle that travels on a road by a built-in battery.

A second invention provides a computer program for model vehicle control, the computer program for controlling entry of a first model vehicle to a section set to a first layout based on information from a position sensor that detects a position of the first model vehicle traveling on the first layout, where the first layout on which the first model vehicle travels and a second layout on which a second model vehicle of a different feeding type from the first model vehicle travels are integrated. This computer program has the following steps. In the step of managing, a computer manages, for each section on the first layout, existence or non-existence of right of possession that is right for the first model vehicle to exclusively use a section, by reference to a first section table. In the step of determining as section determination, the computer determines, by reference to the first section table, whether the right of possession is set to a second section that a target vehicle is about to enter, next to a first section, the target vehicle being the first model vehicle that is to become an object to be controlled and existing in the first section. In the step of determining, the computer determines whether the right of possession is set to a third section set to the second layout on which the second model vehicle travels, by reference to a second section table that manages, for each section on the second layout, existence or non-existence of the right of possession that is right for the second model vehicle to exclusively use a section, when the second section is a section with constraint set in advance as a section crossing with the third section. And in the step of performing, the computer performs exclusive control of not allowing a predetermined number or more of the first model vehicles to enter the second section, based on a determination result of the section determination, and not allowing entry of the target vehicle to the second section, regardless of the determination result of the section determination, until the right of possession of the third section is released, when the second section is the section with constraint, and the right of possession is set to the third section.

In the second invention, the first model vehicle may be a railway model vehicle that travels on a rail by power feed from an outside, and the second model vehicle may be a model vehicle that travels on a road by a built-in battery.

According to the first or second invention, a specific section where a state to obstruct entry to the section due to a cause other than collision with a preceding vehicle occurs is set as a section with constraint, and satisfaction of an entry condition by a current state of the section with constraint is given priority over the section block control. Accordingly, the collision can be avoided in a layout configuration that cannot avoid the collision only by the section block control. Therefore, section block control with flexibility and high extensibility can be realized.

BRIEF DESCRIPTION OF THE DRAWINGS

FIG. 4 is an explanatory diagram of a vehicle position table;

FIG. 5 is an explanatory diagram of a section table;

DETAILED DESCRIPTION

First Embodiment

Figure 1:
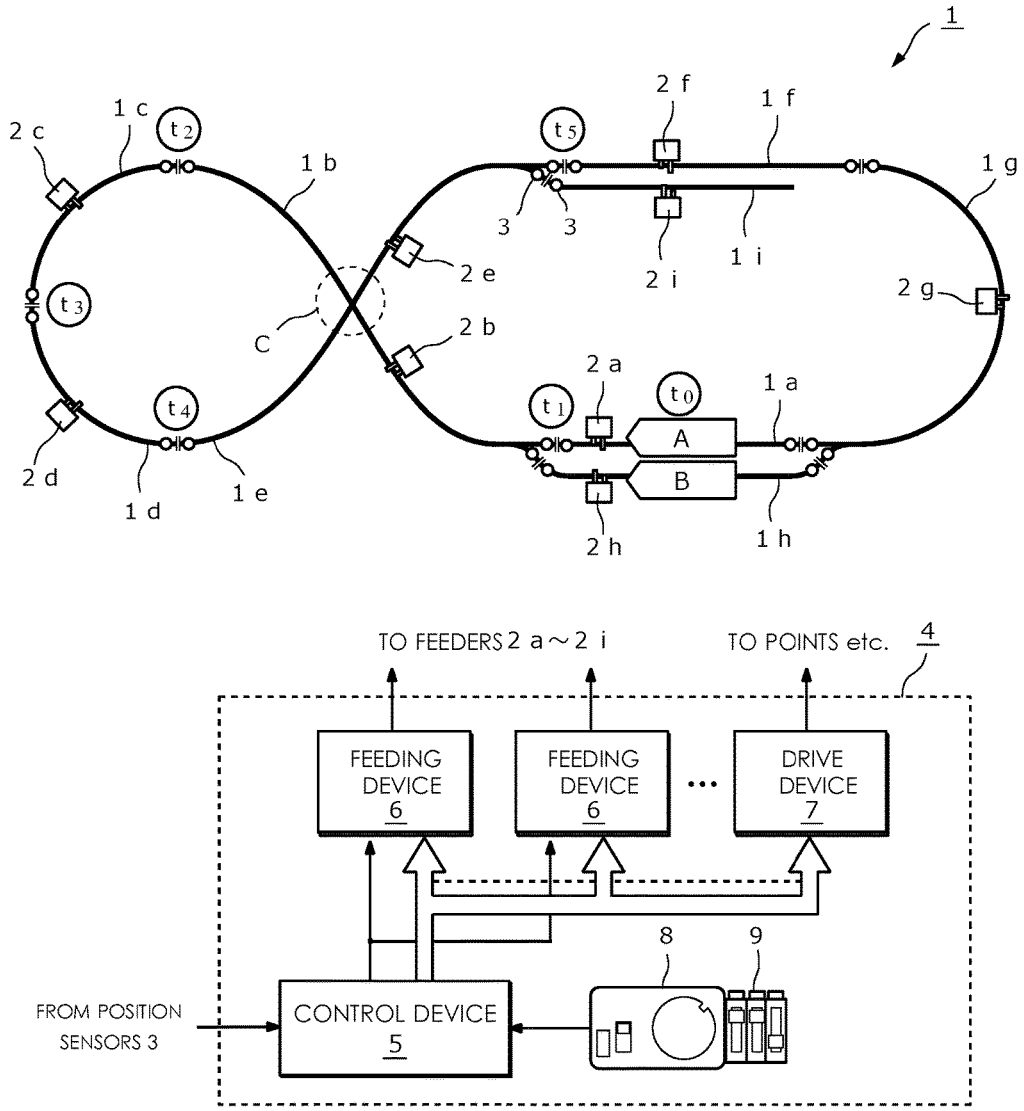
FIG. 1 is an overall configuration diagram of a railway model control system.

FIG. 1 is an overall configuration diagram of a railway model control system. A layout 1 on which a plurality of vehicles including vehicles A and B is configured from a combination of a plurality of rails such as straight rails, curved rails, and points. Basically, a conductive connecting member called joint is used for connection between rails, and the rails electrically connected with the joint form a continuous same section. Further, an insulating connecting member called gap is used for connection between some of rails, and the rails electrically separated with the gap form mutually separated sections. In the example illustrated in FIG. 1, by providing the gaps in ten places in the layout 1, the layout 1 is divided into electrically separated nine sections 1*a* to 1*i*, that is, the seven sections 1*a* to 1*g* that configure a figure-of-eight-shaped endless having the rails cross at a crossing C, the section 1*h* corresponding to a refuge track of double track, and the section 1*i* corresponding to an incoming line branching from the endless. In such a layout 1, respective lengths of the sections 1*a* to 1*i* are, in principle, larger than the maximum length of the vehicles that are supposed to travel on the layout 1, and are favorably lengths that sufficiently anticipate an excessive travel when causing a traveling vehicle to st5Cop. Note that, in the present specification, the "vehicle" refers to one collective traveling unit in terms of control, and includes not only one vehicle (power vehicle) but also a train organized from a plurality of vehicles (the train may include a plurality of power vehicles). Further, a plurality of vehicles that travels together while maintaining an extremely close state, although not physically coupled with one another, is also considered as one "vehicle" as long as the plurality of vehicles is the one collective traveling unit).

In each of the sections 1*a* to 1*i*, any of feeders 2*a* to 2*i* is attached to a connector portion where electrical connection to the rails is performed. Further, position sensors 3 that detect the position of the vehicle are provided to face each other across the gap, near end portions of the respective sections 1*a* to 1*i*. As the position sensor 3, for example, an optical sensor that detects existence of reflection of light associated with passage of the vehicle, a contact sensor that detects existence of contact of wheels equipped to the vehicle, a magnetic sensor that detects a magnet mounted on the vehicle, or a radio frequency identification (RFID) can be used. Further, by monitoring change of a current to be fed to a rail (section), the existence of the vehicle in the section may be detected. Position information detected by the position sensor 3 is input to a control device 5 that configures a part of a control system 4 described below. The reason to arrange the pair of position sensors 3 across the gap is mainly to easily recognize a traveling direction of the vehicle from a temporal order to detect the vehicle. However, the position sensors 3 are not necessarily arranged as a pair as long as the traveling direction can be recognized by another means. Further, any type, number, and installation form of the position sensor 3 can be employed as long as the position sensor 3 can detect the position of the vehicle on the layout 1.

The control system 4 is connected to the layout 1 through wires, and is mainly configured from the control device 5, a plurality of feeding devices 6, a drive device 7, a controller 8, and a point switch 9. The control device 5 is configured from a computer and the like, and performs various types of control such as vehicle speed control of the vehicles A and B on the layout 1, lighting control of headlight and indoor light, and switching of the points. Each of the feeding devices 6 feeds power to a section allocated to the feeding device 6 itself, using pulse width modulation (PWM), in the present embodiment. To be specific, a drive voltage having a pulse width (duty ratio) according to an instruction from the control device 5 is generated, and the drive voltage is supplied to the section as a voltage subjected to the pulse width modulation. The drive device 7 performs switching of the points in the layout 1 according to the instruction from the control device 5. Further, various types of control devices and accessories such as a turntable, a crossing, and a signal may be operated using the drive device 7. The controller 8 is used to control the vehicle speed and the traveling direction when causing the vehicle to travel by a manual operation. Further, the point switch 9 is used to perform switching of the points in this manual operation.

The control device 5 and the lower devices 6 and 7 are connected with wires. In the present embodiment, the interface device 10 and the lower devices are serial-connected (cascade-connected) to reduce the number of cables, and serial data communication is performed between the interface device 10 and the lower devices. This communication is sufficient as long as at least commands from the higher device can be transmitted to the lower devices, and may therefore be unidirectional communication. However, bidirectional communication may be employed, and reception confirmation of the commands may be returned from the lower devices to the higher device. Accordingly, communication accuracy is enhanced, and more reliable control can be performed. Note that the data transfer between the higher device and the lower devices is not limited to the serial data communication, and an arbitrary data communication system can be employed through an arbitrary communication medium such as wired means, wireless means, or light.

Figure 2:
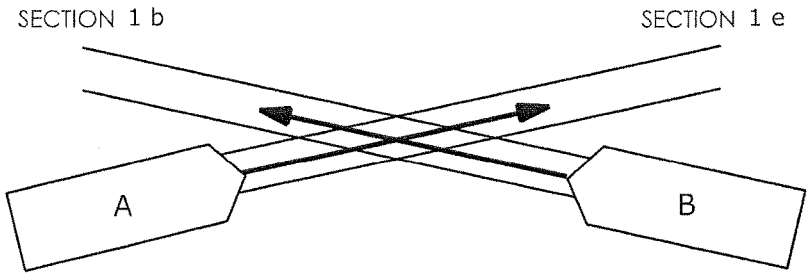
FIG. 2 is an explanatory diagram of crossing rails according to a first embodiment.

FIG. 2 is an explanatory diagram of crossing rails used at the crossing C of FIG. 1. The crossing rails do not have a function of a crossover like points, and are rails where two traveling tracks simply perform level crossing. In FIG. 2, the two traveling tracks, that is, a traveling track that connects the upper left and the lower right and a traveling track that connects the lower left and the upper right are electrically separated from each other, and respectively configure separate sections 1*b* and 1*e*. When the vehicle A in the section 1*e* and the vehicle B in the section 1*b* enter the crossing rail at the same time, the vehicles A and B collide at a crossing portion. It is difficult to avoid the collision by regular section block control, and the present embodiment avoids the collision by taking means described below.

Figure 3:
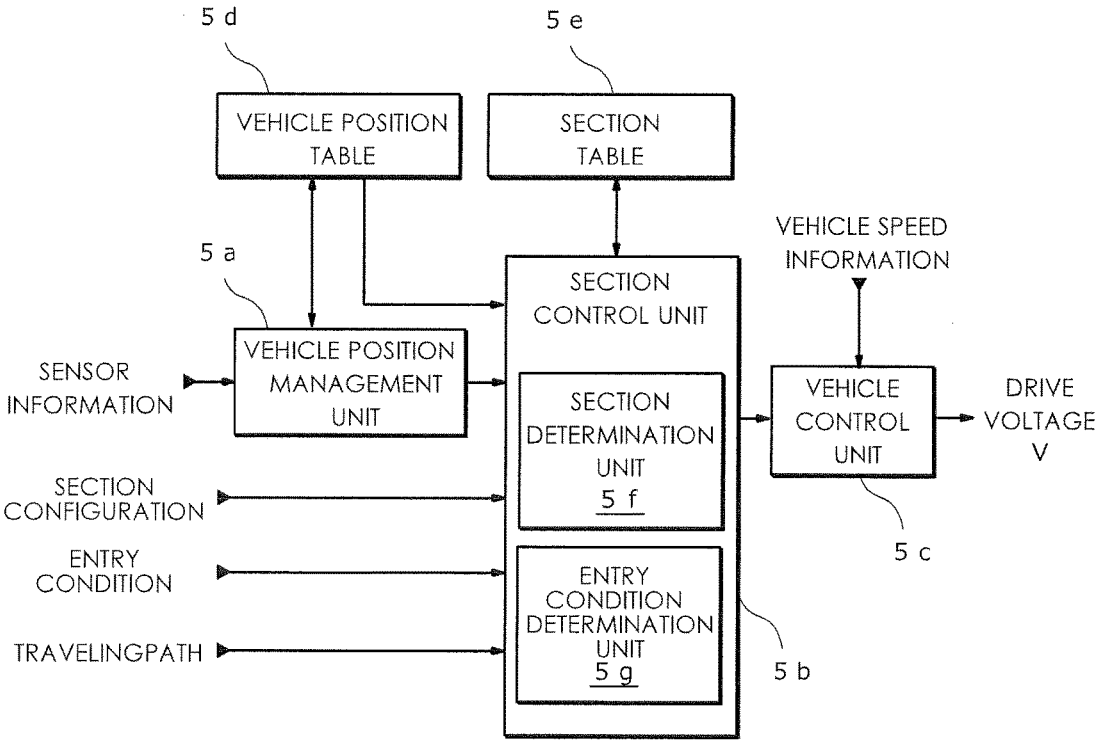
FIG. 3 is a block configuration diagram of a control device.

FIG. 3 is a block configuration diagram of the control device 5. This control device 5 controls entry of a vehicle to the sections 1*a* to 1*i* based on sensor information from the position sensor 3. The control device 5 is mainly configured from a vehicle position management unit 5*a*, a section control unit 5*b*, and a vehicle control unit 5*c*. Further, a vehicle position table 5*d*, a section table 5*e*, and the like are stored in a memory accessible by the control device 5. The vehicle position management unit 5*a* specifies the position of the vehicle on the layout 1 on a section by section basis based on the sensor information from the position sensor 3, and describes a current position in the vehicle position table 5*d*. The section control unit 5*b* includes a section determination unit 5*f* and an entry condition determination unit 5*g*. The section determination unit 5*f* determines whether a preceding vehicle exists in a section that a target vehicle that is to become an object to be controlled is about to enter next. The entry condition determination unit 5*g* determines whether the current state of the section satisfies an entry condition when the next section is a section with constraint. The section control unit 5*b* performs exclusive control of not allowing a plurality of target vehicles to enter the next section based on a determination result of the section determination unit 5*f*. Further, the section control unit 5*b* does not allow entry of the target vehicle to the next section regardless of the determination result of the section determination unit 5*f* until the current state becomes a state that satisfies the entry condition when the next section is the section with constraint and the current section does not satisfy the entry condition.

FIG. 4 is an explanatory diagram of the vehicle position table 5*d*. In this table 5*d*, which vehicles currently exist in the respective sections 1*a* to 1*i* is described. The example of FIG. 4 illustrates that the vehicle A exists in the section 1*a* and the vehicle B exists in the section 1*h* corresponding to the arrangement of the vehicles illustrated in FIG. 1. Note that "0" indicates an available state, that is, no vehicle existing in the section. In the present embodiment, (1) an initial arrangement of the vehicles is determined in advance, (2) the vehicles always continuously travel between adjacent sections, and (3) traveling directions of the vehicles are uniquely identified from the sensor information from the position sensor 3. Therefore, even if the vehicles A and B cannot be identified from the sensor information itself from the position sensor 3, as far as the (1) to (3) are guaranteed, the type of the vehicle existing in the section can be identified. The vehicle position table 5*d* manages current positions of the vehicles A and B in real time, and when the vehicles A and B are moved, the movement is notified to the section control unit 5*b*.

FIG. 5 is an explanatory diagram of the section table 5*e*. In this table 5*e*, existence or non-existence of the right of possession is described for each of the sections 1*a* to 1*i*. The right of possession indicates right to exclusively use the section (resource), in other words, availability of entry to the section, and is given to only one vehicle in the present embodiment. The example of FIG. 5 illustrates that the right of possession of the vehicle A is set to the section 1*a* and the right of possession of the vehicle B is set to the section 1*h* corresponding to the arrangement (stop state) of the vehicles illustrated in FIG. 1. Note that "0" indicates a state where no right of possession is provided. The right of possession can be instantly set to the section to which no right of possession is set. However, the section to which the right of possession has been set is in a stand-by state until the section becomes available. Existence or non-existence of the right of possession of the sections 1*a* to 1*i* is managed by the section table 5*e* in real time, and corresponding to movements of vehicles A and B the state of the right of possession (the number of available sections) is notified to the section control unit 5*b*.

Figures 6, 7:
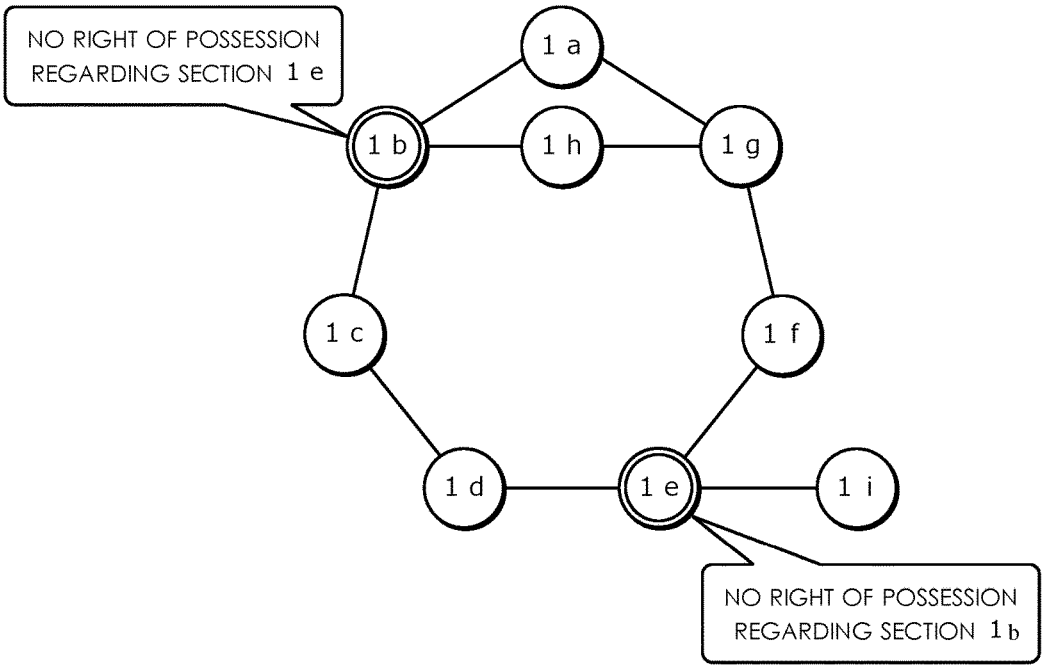
FIG. 6 is an explanatory diagram of a section configuration with an entry condition.
FIG. 7 is an explanatory diagram of a traveling path.

As information to be input to the section control unit 5*b*, information such as a section configuration, the entry condition, and a traveling path is input other than the above-described information of the vehicle position table 5*d*. FIG. 6 is an explanatory diagram of the section configuration in the layout 1 exemplarily illustrated in FIG. 1. Sections linked with a line are adjacent sections, and the sections 1*b*, 1*e*, and 1*g* including the points are adjacent to three sections. With this section configuration, what kinds of connection relationship the respective sections 1*a* to 1*i* have are identified. Here, the double-circled sections 1*b* and 1*e* are "sections with constraint", that is, sections where a state to obstruct entry to the sections occurs due to a cause other than collision with a preceding vehicle. In the present embodiment, a section where a plurality of traveling tracks in the layout 1 crosses or a part of which is shared is set as a section with constraint, and the crossing rail where two traveling tracks cross is a typical case. To the section with constraint, the entry condition of allowing entry to the section is set. In the case of the crossing rail, the entry condition of the section 1*b*, which is one of the traveling tracks, is that no right of possession is set to the section 1*e*, which is the other of the traveling tracks. The entry condition of the section 1*e*, which is the other of the traveling tracks, is that no right of possession is set to the section 1*b*, which is the one of the traveling tracks.

FIG. 7 is an explanatory diagram of the traveling paths of the vehicles A and B. The traveling path is set in advance as information that indicates what kind of path the vehicle travels on the layout 1. The example of FIG. 7 illustrates that the vehicle A goes around the figure-of-eight-shaped endless from the section 1*a* and returns to the section 1*a* again, and the vehicle B goes half around the endless from the section 1*h* and enters the section 1*i* (incoming line). As the information of the traveling paths, vehicle speed information such as acceleration and deceleration in each of the sections may be added.

Figure 8:
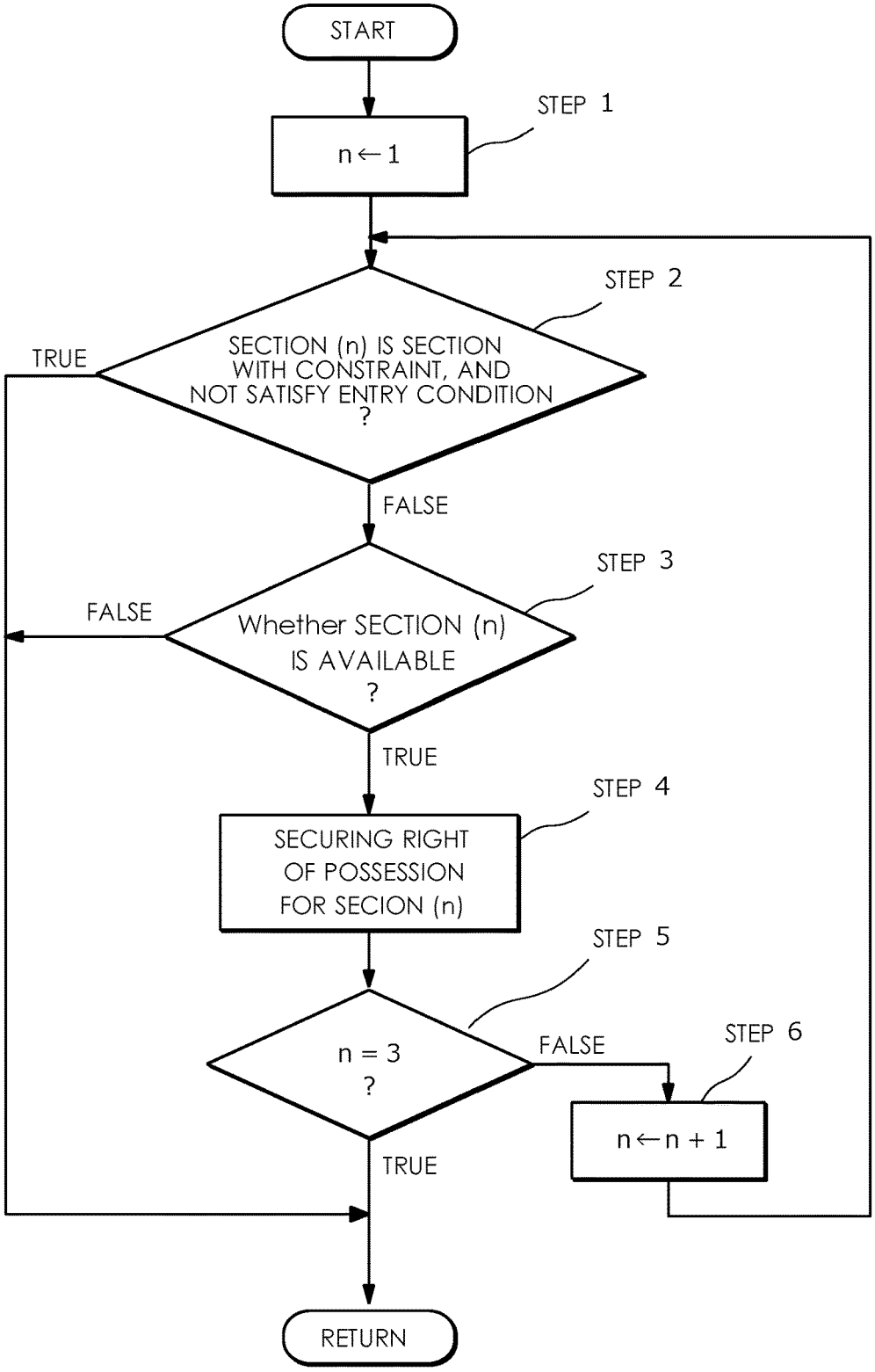
FIG. 8 is a flowchart of a section control routine with entry condition determination.

FIG. 8 is a flowchart of a section control routine executed in the section control unit 5*b*. This routine is repeatedly executed every time the position of the vehicle on the layout 1 is changed, or at predetermined intervals. First, in step 1, a loop variable n is set to "1". Next, in step 2, whether a section of n sections ahead is the section with constraint, and whether the current state does not satisfy the entry condition are determined. Whether a section is the section with constraint is set in advance in the system, and when the section of n sections ahead is the section with constraint, determination as to whether the current state satisfies the entry condition is made according to whether the right of possession is set to the section associated with the section with constraint, by reference to the section table 5*e*, as described above. For example, when the section of n sections ahead is the section 1*b* (the section with constraint), the entry condition of the section 1*b* being satisfied is determined based on the fact that no right of possession is set to the section 1*e* associated with the section 1*b*. When a determination result of step 2 is "true", that is, when the section where the vehicle (target vehicle) that is to become the object to be controlled is currently positioned is the section with constraint, and the current state does not satisfy the entry condition, procedures of step 3 and subsequent steps are skipped, and the present routine is gone through. In contrast, when the determination result of step 2 is "false", that is, when (1) the section of n sections ahead is not the section with constraint, or (2) when the section of n sections ahead is the section with constraint but the current state satisfies the entry condition, the processing proceeds to step 3. In step 3, whether the section of n (=1) section ahead is available, that is, the section in the section table 5*e* is "0" (the right of possession is not set) is determined by reference to section table 5*e*. When the determination result of step 3 is "false", procedures of step 4 and subsequent steps are skipped, and the present routine is gone through. When the determination result of step 3 is "true", the processing proceeds to step 4, and the right of possession of the target vehicle is secured about the section of n (=1) section ahead and the securement of the right of possession is written to the section table 5*e*. With the securement of the right of possession, entry of the target vehicle to the section of n (=1) section ahead is allowed. Then, in the following step 5, whether the loop variable n has reached "3". When the loop variable has not yet reached "3", "1" is added to the loop variable n (step 6), and the processing returns to step 2 and the procedure of step 2 and subsequent steps are repeated. In contrast, when the loop variable n has reached "3", the determination result of step 5 becomes "true", and the present routine is gone through.

According to the present routine, starting from the securement of the right of possession of one section ahead from the current section, and securement of the right of possession up to a section of three sections ahead is attempted. Then, if the right of possession of a certain section cannot be secured, securement of the right of possession of sections ahead from the certain section is not attempted. Further, when the section of n sections ahead is the section with constraint, and the current state about existence/non-existence of the right of possession does not satisfy the entry condition (the right of possession is not set), the content of the section table 5*e* is updated, and entry of the target vehicle to the section of n sections ahead is not allowed until the current state becomes a state that satisfies the entry condition.

Figure 9:
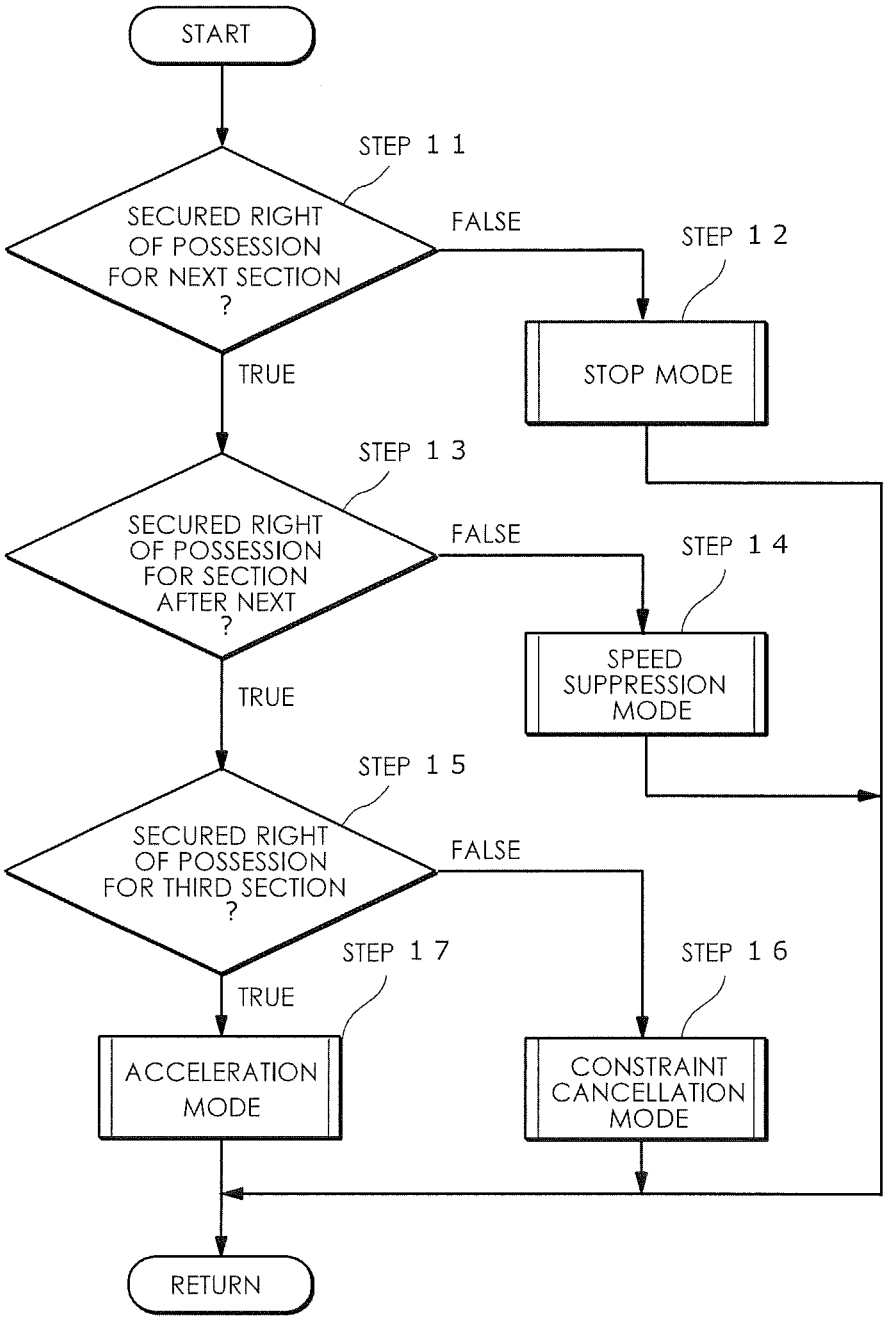
FIG. 9 is a flowchart of a vehicle control routine.

FIG. 9 is a flowchart of a vehicle control routine executed in the vehicle control unit 5*c*. When the right of possession of a section ahead of the current section cannot be secured, that is, when another vehicle currently exists in the next section, or when another vehicle is about to enter the next section, a stop mode is set according to the determination result of step 11 (step 12). In the stop mode, the target vehicle is forcibly stopped in the current section regardless of a vehicle speed programmed in advance, in a case of an automatic operation. Further, in a case of a manual operation, the target vehicle is stopped similarly to the automatic operation, or a user is prompted to perform a stop operation, by lighting a display light of the controller 8 or issuing an alarm from a speaker. Further, when the right of possession is secured for only up to the one section ahead, a speed suppression mode is set according to the determination results of steps 11 and 13 (step 14). In the speed suppression mode, the vehicle speed is forcibly decelerated to a predetermined speed limit regardless of the vehicle speed programmed in advance (in a case where the vehicle speed is larger than the speed limit) in the case of the automatic operation. Further, in the case of the manual operation, the vehicle speed is decelerated similarly to the automatic operation, or the user is prompted to perform a deceleration operation, by lighting the display light of the controller 8 or issuing an alarm from the speaker. Further, when the right of possession can be secured for only up to the two sections ahead, a constraint cancellation mode is set according to the determination results of steps 11, 13, and 15 (step 16). In the constraint cancellation mode, the vehicle speed is set according to the vehicle speed programmed in advance in the case of the automatic operation. Further, in the case of the manual operation, the vehicle speed is controlled according to the operation of the controller 8. When the right of possession can be secured for up to the three sections ahead, an acceleration mode is set according to the determination results of steps 11, 13, and 15 (step 17). In the acceleration mode, the vehicle speed is accelerated to a higher speed than the vehicle speed programmed in advance in the case of the automatic operation. Further, in the case of the manual operation, the vehicle speed is controlled according to the operation of the controller 8. At that time, the user may be prompted to perform acceleration through the display light of the controller 8 or the speaker.

Figures 10, 11:
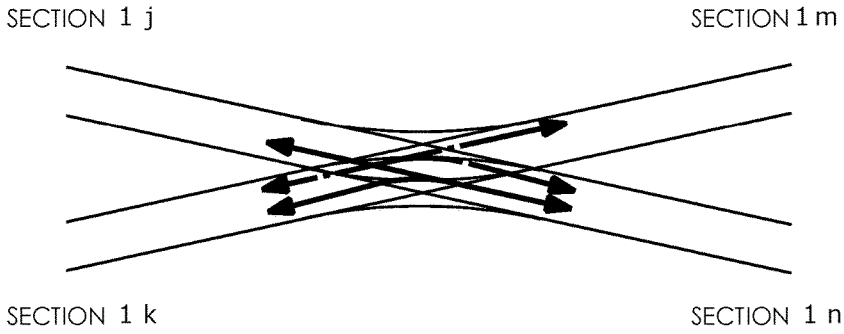
FIG. 10 is a transition table of a section table.
FIG. 11 is an explanatory diagram of double slip points according to a second embodiment.

FIG. 10 is a transition table of the section table 5*e* in a case where the section block control is performed based on the traveling paths of FIG. 7. In an initial state, the right of possession of the vehicle A is allocated to the section 1*a* where the vehicle A exists, and the right of possession of the vehicle B is allocated to the section 1*h* where the vehicle B exists, according to the arrangement of the vehicles A and B illustrated in FIG. 1. For convenience of understanding, the bold letters in the table indicate the sections where the vehicles A and B currently exist. Further, the blanks indicate "0".

When it becomes timing t0 when the stopped vehicle A is departed, securement of the right of possession is attempted about the sections 1*b* to 1*d* that three sections ahead from the current section 1*a* where the vehicle A exists. The section 1*b* is the section with constraint, and its entry condition is that "no right of possession is set to the section 1*e*". At the timing to, the section 1*e* is "0". Therefore, the entry condition is satisfied, and the sections 1*b* to 1*d* are "0". Therefore, the right of possession of the sections 1*b* to 1*d* is allocated to the vehicle A. Accordingly, the vehicle A in the section 1*a* is started to accelerate in the acceleration mode.

At timing t1 when the vehicle A has entered the section 1*b*, the right of possession of the section 1*a* is released, and the right of possession of the section 1*e* is secured by the vehicle A. Note that the section 1*e* is the section with constraint, but the right of possession of the section 1*b* that is the entry condition of the section 1*e* has already been secured by the vehicle A. Therefore, it is no problem. Accordingly, the vehicle A continuously travels in the acceleration mode. Immediately after the timing t1, when it becomes timing when the stopped vehicle B is departed, securement of the right of possession is attempted about the sections 1*b* to 1*d* that are three sections ahead from the current section 1*h* of the vehicle B. However, at this point of time, the right of possession of the section 1*e* has already been secured by the vehicle A, and thus the entry condition of the section with constraint 1*b* is not satisfied. Therefore, the vehicle B remains stopped in the section 1*h*.

At timing t2 when the vehicle has entered the section 1*c*, the right of possession of the section 1*b* is released, and the right of possession of the section 1*f* is secured by the vehicle A. Accordingly, the vehicle A continuously travels in the acceleration mode. While the section 1*b* ahead of the current section 1*h* of the vehicle B becomes available, the entry condition of the section 1*b* has not yet been satisfied. Therefore, the vehicle B remains stopped in the section 1*h*. This stop state is continued until timing t5 when the vehicle A enters the section 1*f*.

At the timing t5 when the vehicle A has entered the section 1*f*, the right of possession of the section 1*e* is released. Accordingly, the entry condition of the section with constraint 1*b* is satisfied, and thus the right of possession of the section 1*b* is allocated to the vehicle B. Along with that, the right of possession of the sections 1*c* and 1*d* ahead of the section 1*b* is also allocated to the vehicle B. Accordingly, the vehicle B of the section 1*h* is started to accelerate in the acceleration mode. After that, the vehicles A and B respectively travel toward the sections 1*a* and 1*i*, which are end points, according to the traveling paths without interference with each other.

According to the first embodiment, the specific section where a state to obstruct entry to the section occurs due to a cause other than collision with a preceding vehicle is set as the section with constraint, and satisfaction of the entry condition by the current state of the section with constraint is given priority over the determination result of the section determination unit 5*f*. Accordingly, the crossing rail that cannot be supported only with the determination result of the section determination unit 5*f* becomes supportable. Therefore, section block control with high extensibility can be realized.

Note that, in the first embodiment, the available states of up to three sections ahead from the current section are monitored, and acceleration, cancellation of the constraint, suppression of speed, and stop are set according to the monitoring result. However, it is sufficient to switch only travel/stop by monitoring at least one section ahead. Further, it is possible to more finely control the vehicle speed by monitoring up to four or more sections ahead.

Second Embodiment

FIG. 11 is an explanatory diagram of double slip points according to a second embodiment. The double slip points perform level crossing with double crossovers and include electrically separated four sections 1*j* to 1*n*. By switching of tongue rails, two traveling tracks can be selected in two directions. When the tongue rail is set to a straight direction, the traveling track is formed in a direction connecting the sections 1*j* and 1*n* (or the sections 1*k* and 1*m*). Further, when the tongue rail is set to a curved direction, the traveling track is formed in a direction connecting the sections 1*j* and 1*m* (or the sections 1*k* and 1*n*). The straight direction or the curved direction, whichever the tongue rail is set, vehicles collide at a crossing portion, similarly to the above-described crossing rail. Therefore, each of the sections 1*j* to 1*n* including the double slip points is set as a section with constraint, and an entry condition thereof is set such that another vehicle does not enter the other traveling track that is different from one traveling track corresponding to the section with constraint, regardless of the set direction of the double slip points. To be specific, no right of possession being set to any of the other three sections 1*k*, 1*m*, and 1*n* is the entry condition of the section 1*j*. Accordingly, the collision of the vehicles can be prevented without considering the traveling directions of the vehicles.

As described above, according to the second embodiment, the double slip points, which cannot be supported only with a determination result of a section determination unit 5*f*, can be supported. Therefore, section block control with high extensibility can be realized, similarly to the first embodiment. Note that, as a modification of the second embodiment, the sections with constraint may be set to a single slip point that does level crossing with a single crossover, similarly to the case of the double crossing points.

Third Embodiment

Figure 12:
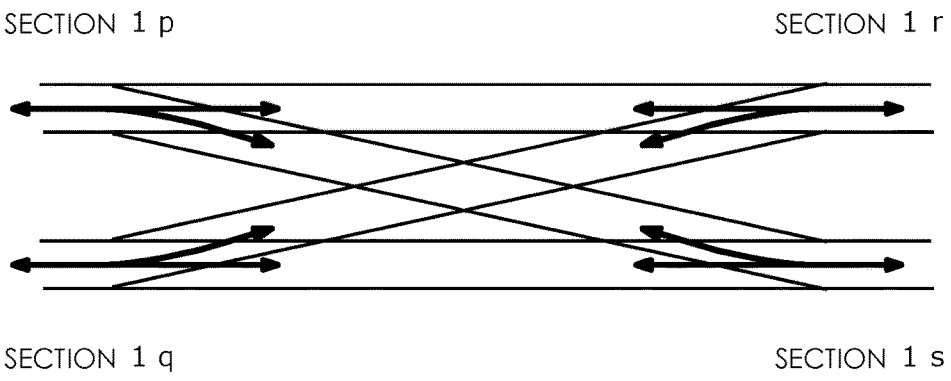
FIG. 12 is an explanatory diagram of double crossing points according to a third embodiment.

FIG. 12 is an explanatory diagram of double crossing points according to a third embodiment. The double crossing points also perform level crossing with double crossovers. However, unlike the double slip points, collision of vehicles at a crossing portion does not occur when rails are set in a straight direction. The double crossing points include electrically separated four sections 1*p* to 1*s*, and two traveling tracks can be selected in two directions by switching of tongue rails. When the tongue rail is set to a straight direction, the traveling track is formed in a direction connecting the sections 1*p* and 1*r* (or the sections 1*q* and 1*s*). Further, when the tongue rail is set to a curved direction, the traveling track is formed in a direction connecting the sections 1*p* and 1*s* (or the sections 1*q* and 1*r*). When the tongue rail is set to the curved direction, the vehicles collide at a crossing portion, similarly to the above-described crossing rail. Therefore, each of the sections 1*p* to is including the double crossing points is set as a section with constraint, and an entry condition thereof is set such that the double crossing point is set to the curved direction, and another vehicle does not enter the other traveling track that is different from one traveling track corresponding to the section with constraint. Accordingly, the collision of the vehicles can be prevented without considering the traveling directions of the vehicles. The set direction of the points may be managed with a table, or may be managed by physically or electrically monitoring switching states of point switches.

As described above, according to the third embodiment, the double crossing points, which cannot be supported only with a determination result of a section determination unit 5*f*, can be supported. Therefore, section block control with high extensibility can be realized, similarly to the first embodiment.

Fourth Embodiment

Figure 13:
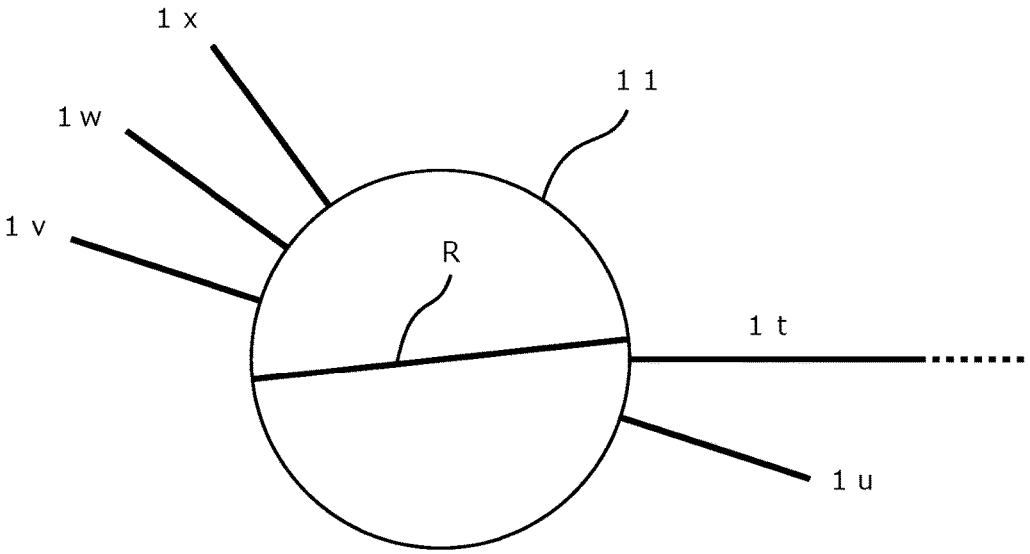
FIG. 13 is an explanatory diagram of a turntable according to a fourth embodiment.

FIG. 13 is an explanatory diagram of a turntable according to a fourth embodiment. In a turntable 11, traveling tracks do not directly cross, unlike the above-described points. However, a rail R on the turntable 11 is shared. Therefore, a state to obstruct entry to a section may occur. A plurality of rails radially extending from the turntable 11 forms sections 1*t* to 1*x*, which are independent of one another. However, the rail R on the turntable conducts with any of the radially-shaped rails connected as traveling tracks and thus is not one independent section. Therefore, each of the sections 1*t* to 1*x* connected to the turntable 11 is set as a section with constraint, and an entry condition thereof is set such that no right of possession is set to the other sections. Accordingly, collision of vehicles can be prevented without considering traveling directions of the vehicles.

As described above, according to the fourth embodiment, the turntable 11, which cannot be supported only with a determination result of a section determination unit 5*f*, can be supported. Therefore, section block control with high extensibility can be realized, similarly to the first embodiment.

Fifth Embodiment

Figure 14:
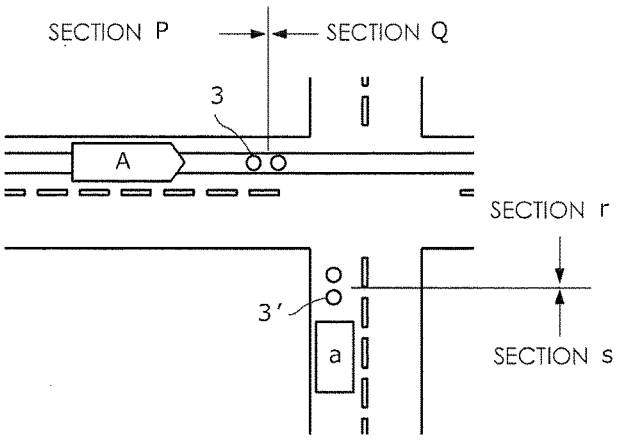
FIG. 14 is an explanatory diagram of an integrated layout according to a fifth embodiment.

FIG. 14 is an explanatory diagram of an integrated layout of a train (tram) and a bus according to a fifth embodiment. A tram A travels on rails installed in a road by power feed from an outside, and a bus a travels by a built-in battery. A magnet linked with a steering angle of front wheels is attached to the bus a, and the magnet is displaced along guide rails attached in a back side of the road, so that the bus a travels along the road. The bus a can be switched to travel/stop with a sensor 3' (for example, an RFID) installed on the road side. This sensor 3' also has a function as the above-described position sensor 3, and the above-described section block control is performed based on sensor information of the position sensor 3. The tram A and the bus a have different control systems and may collide at a crossing. Therefore, it is necessary to arbitrate the tram A and the bus a.

Figure 15:
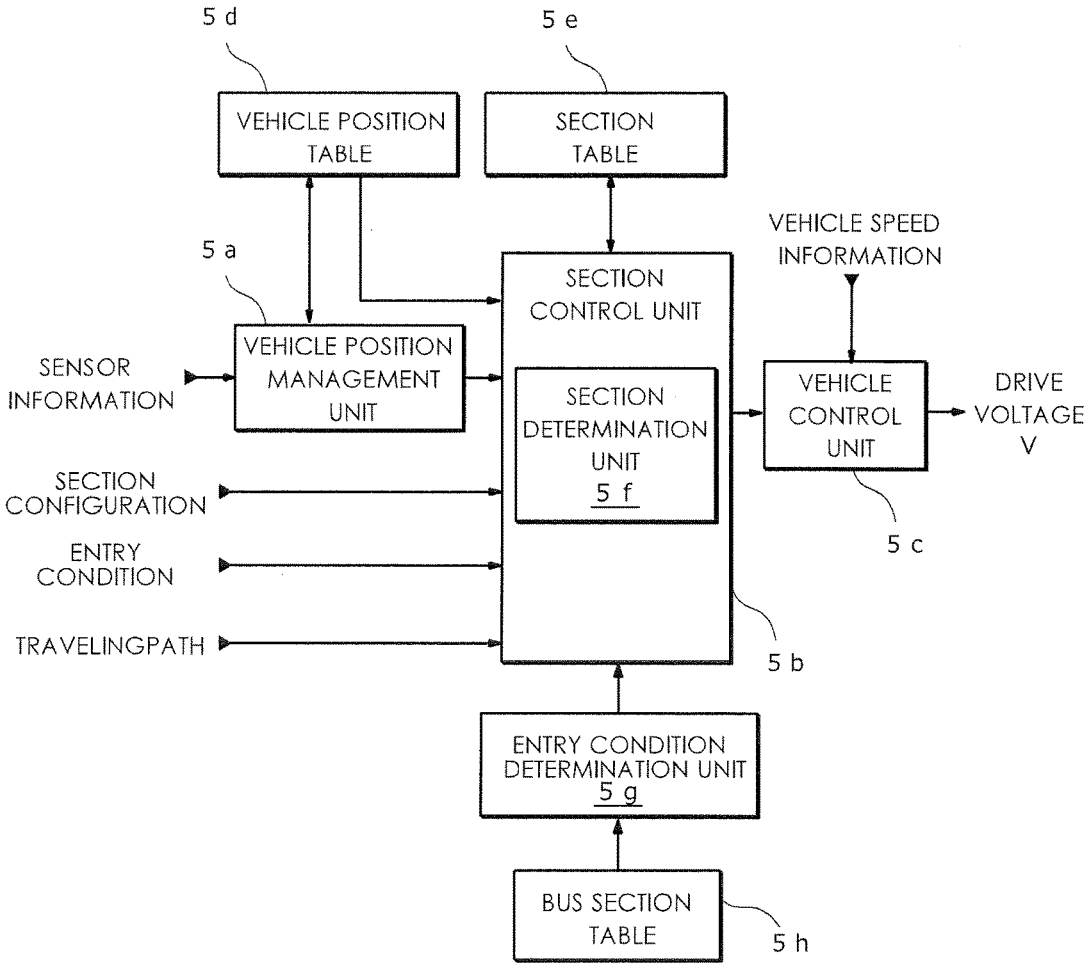
FIG. 15 is a block configuration diagram of a control device according to a fifth embodiment.

FIG. 15 is a block configuration diagram of a control device 5 according to the fifth embodiment. The first to fourth embodiments are the same system using the same type of vehicles, and the determination of the entry condition performed by the entry condition determination unit 5*g* can be sufficiently done by reference to the same section table 5*e*, similarly to the section determination unit 5*f*. However, the tram A and the bus a have different control systems, and thus the position of the bus a cannot be grasped with a section table 5*e* (for the tram A). An entry condition determination unit 5*g* is provided outside a section control unit 5*b*, and arbitration of the tram A and the bus a is performed by reference to a bus section table 5*h* for performing section block control of the bus a. To be specific, a section Q where the tram A travels is set to a section with constraint, and an entry condition thereof is set such that no right of possession is set for a section r where the bus a travels. The right of possession of the bus a is managed by a bus control system in real time, and a state of the right of possession is described in the bus section table 5*h*. The entry condition determination unit 5*g* determines whether a current state of the section r satisfies the entry condition in allocating the right of possession to the section Q by reference to the bus section table 5*h*. Accordingly, the tram A and the bus a can be arbitrated so that no collision occurs at the crossing. Other points are similar to the configuration of FIG. 3, and thus the same reference numerals are denoted and description here is omitted.

As described above, according to the fifth embodiment, a link with a different type of control system, which cannot be supported only with a determination result of a section determination unit 5*f*, becomes possible. Therefore, section block control with high extensibility can be realized.

Sixth Embodiment

Figure 16:
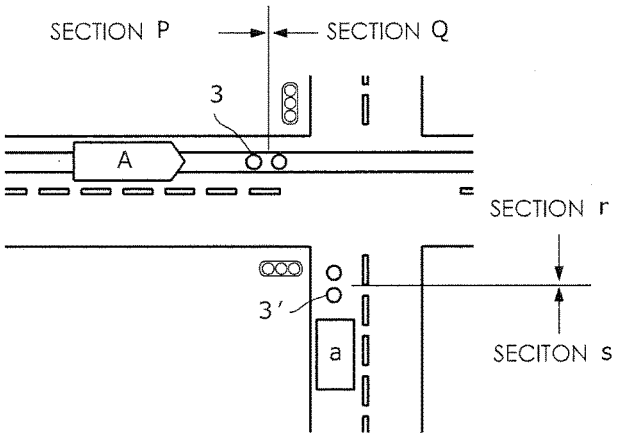
FIG. 16 is an explanatory diagram of an integrated layout according to a sixth embodiment.

FIG. 16 is an explanatory diagram of an integrated layout according to a sixth embodiment. In the present embodiment, a lighting state of a traffic light at a crossing is used as an entry condition, instead of using a section occupation by a bus a as an entry condition. A lighted color of the traffic light at the crossing is switched in real time regardless of traveling of the tram A and the bus a.

Figure 17:
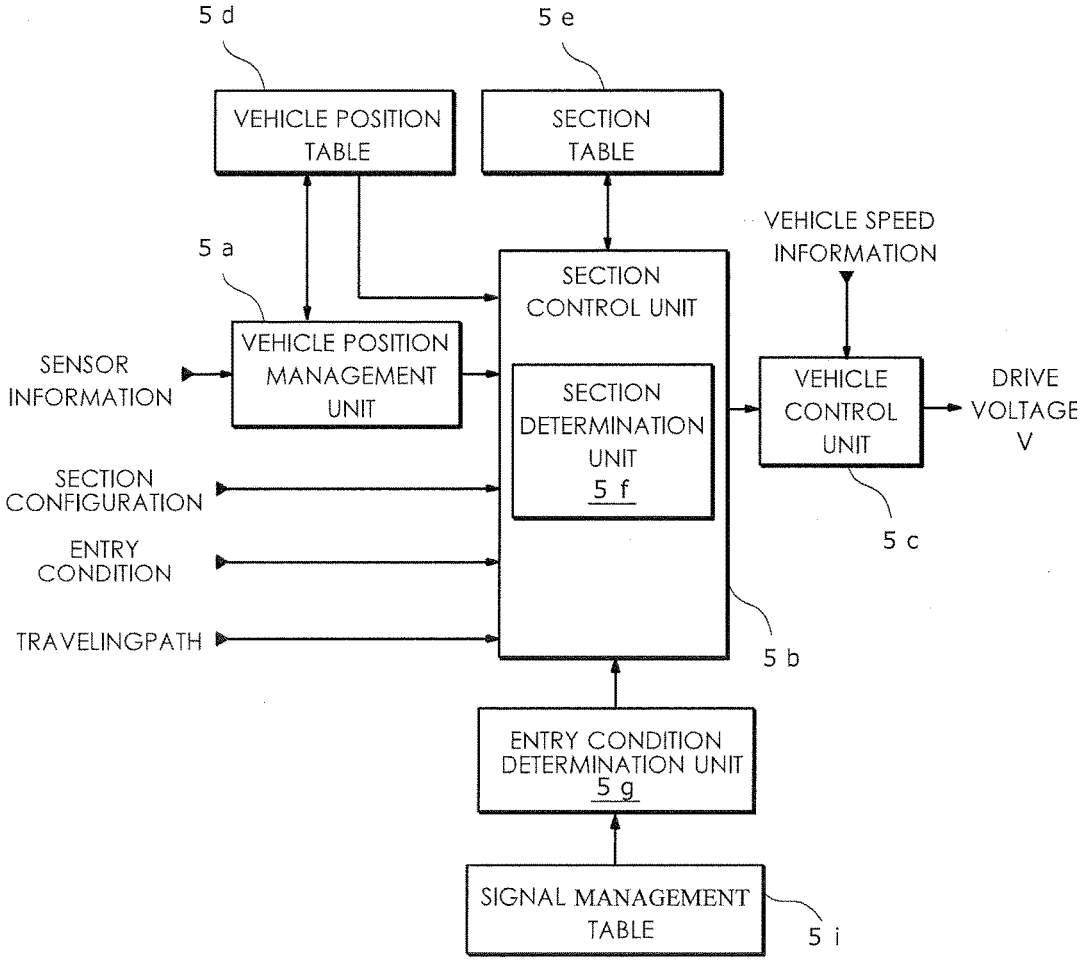
FIG. 17 is a block configuration diagram of a control device according to the sixth embodiment.

FIG. 17 is a block configuration diagram of a control device according to a sixth embodiment. An entry condition determination unit 5*g* is provided outside a section control unit 5*b*, and the tram A and the bus a are controlled by reference to a signal management table 5*i* that manages the lighting state of the traffic light. To be specific, a section Q where the tram A travels is set as a section with constraint, and an entry condition thereof is set such that the traffic light in a traveling direction is not red. The lighting state of the traffic light is managed by a lighting control system in real time, and is described in the signal management table 5*i*. An entry condition determination unit 5*g* determines whether a current state in the traffic light in the traveling direction satisfies the entry condition in allocating the right of possession to the section Q by reference to the signal management table 5*i*. Accordingly, the tram A and the bus a can be arbitrated so that the tram A and the bus a do not collide at the crossing. Other points are similar to the configuration of FIG. 3, and thus the same reference numerals are denoted and description here is omitted.

As described above, according to the sixth embodiment, section block control with high extensibility can be realized, similarly to the fifth embodiment.

In the above-described embodiments, the pulse width modulation is used as the feeding system of the railway model vehicle. However, that is an example, and regular direct current control (DC control) that makes a direct current voltage value itself variable may be use. Further, a system called digital command control (DCC) may be used in place of the DC control. In the DCC, a decoder is mounted on a vehicle that is to become an object to be controlled, and a command from a controller is transmitted to the decoder at the vehicle side through rails that configure a layout. In this command, an address is attached, and only the decoder corresponding to the specified address executes the command, so that control such as driving of a drive motor and lighting of lights is separately controlled. An alternating current of about 12 V flows in the layout on a steady basis, and the decoder converts the alternating current into a direct current and drives a motor mounted on the vehicle according to the command, so that a vehicle speed is controlled. In a case of using the DCC, distributed feed like the DC control is not necessarily required, and the entire layout may be fed from a feeder in one place. Further, any model vehicle may be employed as long as the model vehicle collects a current from a feeding path of a rail or the like and self-propels, and a current-collecting shoe or the like may be used to collect the current, in place of wheels. Further, a vehicle that does not require power feed from an outside and self-propels by a built-in battery or the like may be employed as long as traveling can be controlled from an outside, like the above-described bus a. Especially, if a front monitoring sensor is provided in a front surface of the bus a, and a distance between the bus a and a preceding vehicle is adjusted, collision can be effectively avoided even if a plurality of buses a enters one section. In that context, the number of vehicles that can enter one section in the section block control according to the present invention is not limited to one, and a predetermined number or less may be employed.

Further, in the above-described embodiments, application examples to a railway model have been described. However, the present invention is not limited to the examples, and can be widely applied to various types of model vehicles. Further, in the above-described section block control, the number of vehicles that can enter the section is limited to one. However, for example, a predetermined number (including a plurality) of vehicles may be employed to realize a situation where a plurality of buses travels on a road in a bumper-to-bumper manner. In this case, if an obstacle in front is detected with a front sensor built in the bus and the bus is stopped, the above-described section block control can be applied as it is.

Further, functionally equivalents to the function realized by the configuration of the control device 5 illustrated in FIG. 3 and the like can be realized using a computer program.

What is claimed is:

1. A model vehicle control device that controls entry of a first model vehicle to a section set to a first layout based on information from a position sensor that detects a position of the first model vehicle traveling on the first layout, where the first layout on which the first model vehicle travels and a second layout on which a second model vehicle of a different feeding type from the first model vehicle travels are integrated, the control device comprising:

a first section table configured to manage, for each section on the first layout, existence or non-existence of right of possession that is right for the first model vehicle to exclusively use a section;

a section determination unit configured to determine, by reference to the first section table, whether the right of possession is set to a second section that a target vehicle is about to enter, next to a first section, the target vehicle being the first model vehicle that is to become an object to be controlled and existing in the first section;

an entry condition determination unit configured to determine whether the right of possession is set to a third section set to the second layout on which the second model vehicle travels, by reference to a second section table that manages, for each section on the second layout, existence or non-existence of the right of possession that is right for the second model vehicle to exclusively use a section, when the second section is a section with constraint set in advance as a section crossing with the third section; and a section control unit configured to perform exclusive control of not allowing a predetermined number or more of the first model vehicles to enter the second section, based on a determination result of the section determination unit, and not to allow entry of the target vehicle to the second section, regardless of the determination result of the section determination unit, until the right of possession of the third section is released, when the second section is the section with constraint, and the right of possession is set to the third section.

2. The model vehicle control device according to claim 1, wherein the first model vehicle is a railway model vehicle that travels on a rail by power feed from an outside, and the second model vehicle is a model vehicle that travels on a road by a built-in battery.

3. A method for controlling entry of a first model vehicle to a section set to a first layout based on information from a position sensor that detects a position of the first model vehicle traveling on the first layout, where the first layout on which the first model vehicle travels and a second layout on which a second model vehicle of a different type from the first model vehicle travels are integrated, the method comprising:

managing, by a model vehicle control device, for each section on the first layout, existence or non-existence of right of possession that is right for the first model vehicle to exclusively use a section, by reference to a first section table;

determining, by the model vehicle control device, as section determination, by reference to the first section table, whether the right of possession is set to a second section that a target vehicle is about to enter, next to a first section, the target vehicle being the first model vehicle that is to become an object to be controlled and existing in the first section;

determining, by the model vehicle control device, whether the right of possession is set to a third section set to the second layout on which the second model vehicle travels, by reference to a second section table that manages, for each section on the second layout, existence or non-existence of the right of possession that is right for the second model vehicle to exclusively use a section, when the second section is a section with constraint set in advance as a section crossing with the third section; and performing, by the model vehicle control device, exclusive control of not allowing a predetermined number or more of the first model vehicles to enter the second section, based on a determination result of the section determination, and not allowing entry of the target vehicle to the second section, regardless of the determination result of the section determination, until the right of possession of the third section is released, when the second section is the section with constraint, and the right of possession is set to the third section.

4. The method according to claim 3, wherein the first model vehicle is a railway model vehicle that travels on a rail by power feed from an outside, and the second model vehicle is a model vehicle that travels on a road by a built-in battery.

* * * * *